United States Patent [19]

Winters

[11] Patent Number: 4,744,528

[45] Date of Patent: May 17, 1988

[54] COLLAPSIBLE REEL

[75] Inventor: Leo M. Winters, Eindhoven, Netherlands

[73] Assignee: U.S. Philips Corporation, New York, N.Y.

[21] Appl. No.: 33,712

[22] Filed: Apr. 3, 1987

[30] Foreign Application Priority Data

Dec. 22, 1986 [NL] Netherlands ..... 8603248

[51] Int. Cl.[4] ..... B65H 75/18

[52] U.S. Cl. ..... 242/71.8; 242/115

[58] Field of Search ..... 242/71.8, 115, 118.8, 242/71.9; 206/395, 396, 405, 389

[56] References Cited

U.S. PATENT DOCUMENTS

| | | | |
|---|---|---|---|
| 2,545,004 | 3/1951 | Ortenblad et al. | 242/71.8 |
| 2,992,791 | 7/1961 | Johnson | 242/118.8 |
| 3,222,011 | 12/1965 | Webb | 242/118.8 |
| 3,284,022 | 11/1966 | Eifrid | 242/115 X |
| 3,301,500 | 1/1967 | Shackson | 242/115 X |
| 3,329,259 | 7/1967 | Mayer . | |
| 3,817,475 | 6/1974 | Goldstein | 242/115 |
| 3,853,286 | 12/1974 | Beder et al. | 242/115 |
| 4,003,529 | 1/1977 | Nigro | 242/118.8 |
| 4,179,030 | 12/1979 | Hayes | 206/396 |

*Primary Examiner*—John M. Jillions

*Attorney, Agent, or Firm*—Robert T. Mayer

[57] ABSTRACT

A collapsible reel (31) composed of two identical reel halves (1, 1') each comprising a flat annular flange (3, 3') having a central opening (5, 5') and a number of annular segments (7, 7') which are bounded by loop-shaped incisions (9, 9') and which are joined to the flange (3, 3') by a folding rib. Each segment (7, 7') is subdivided by a hinge rib into a securing vane (15, 15') and a bridge part (17, 17'). By means of the securing vanes (15, 15'), the two flanges (3, 3') are joined. The folding ribs (11, 11') and the hinge ribs (13, 13') are arranged so that the reel (31) can be extended merely by a relative rotational movement of the two flanges (3, 3').

10 Claims, 3 Drawing Sheets

COLLAPSIBLE REEL

The invention relates to a collapsible reel which is composed of two identical halves each consisting of a flat annular flange having a central opening and a number of expansion members. The expansion members are arranged near the central opening and are regularly distributed in the circumferential direction. They are bounded by incisions and by ribs which extend transversely to the incisions and each have a securing vane and a bridge part. The securing vane is joined to the bridge part by a folding rib and the bridge part is joined to the flange by a hinge rib extending parallel to the folding rib. The two reel halves are joined by means of the securing vanes to form a reel which can be extended due to a relative movement of the two reel halves, the bridge parts constituting the reel core.

For storing, packing and transporting tape- and ribbon-shaped products and products packed in tape, strip or ribbon material, such as electric and electronic components, use is preferably made of reels. Especially due to the fact that SMD components are increasingly processed mechanically, the reels of different dimensions and of different constructions are increasingly employed.

In order to ensure that empty reels can be supplied to the user as efficiently as possible and with a minimum of transport volume, use is preferably made of collapsible reels, which, when empty and in the collapsed state, occupy little volume and which can be extended by the user by a simple operation in order to arrange the products to be packed on the reel.

Such a collapsible reel of the kind described in the opening paragraph is known from U.S. Pat. No. 3,284,022. In order to extend this reel and to make it ready for use, the two flanges must be pulled away from each other in the axial direction. The reel flanges compressed during the assembly and during the transport can often be separated from each other only with difficulty. The operation of pulling the reel halves away from each other cannot readily be controlled and may be effected shockwise so that the risk of damage of the reel by tearing is fairly high.

The invention has for its object to provide a collapsible reel which can be brought into the condition ready for use in a simple manner by a simple and satisfactory controllable operation and with comparatively little effort.

According to the invention, this object is mainly achieved in that the incisions extend substantially in or tangentially to the circumferential direction of the central opening and in that the folding ribs and the hinge ribs are arranged in such a manner that the reel can be extended by a relative rotational movement of the two reel halves.

The rotational movement can be effected with little effort and uniformly so that the risk of damage of the reel by tearing, especially with the use of thin-walled material, is small. The angular rotation to be performed can be satisfactorily controlled.

A preferred embodiment of the collapsible reel according to the invention is characterized in that the expansion members take the form of an annular segment and are bounded by a loop-shaped incision composed of lines of a circle.

The characteristic form and location of the expansion members has the consequence that due to the hinge effect of the folding ribs and the hinge ribs the two flanges are moved apart in the axial direction merely by a relative displacement of the two reel halves in the circumferential direction. No problems are involved in separating the two flanges from each other because the axial expansion movement of the two reel flanges is an inevitable consequence of their relative rotational movement.

Another preferred embodiment of the collapsible reel according to the invention is characterized in that the folding rib and the hinge rib enclose an acute angle with a radius intersecting the relevant rib. Thus, it is achieved that the center line of the ribs extends at a certain distance from the center of the central opening and on either side thereof and that the ribs are inclined slightly backwards with respect to the free end of the expansion member. Due to the fact that the ribs are inclined backwards, a wringing effect or torsional effect is exerted on the bridge parts as a result of the relative rotational movement of the flanges in such a manner that the bridge parts pivot in the correct desired direction of rotation. Moreover, the flanges can more readily be separated due to the torsional effect.

According to the invention, another preferred embodiment of the reel is characterized in that the incisions are widened in such a manner that the expansion members are not in contact with the flange along the incision. Due to this step the expansion members, more particularly the securing vanes, do not hook on to the flange, and as a result a large force does not have to be exerted at the beginning of the relative displacement, which could involve the risk to damage of the reel. Due to the fact that the expansion members are wholly disengaged along their incised circumference, the hinge effect of the folding rib and the hinge rib is facilitated.

The hinge effect of the hinge rib and the operation of separating the flanges are further facilitated in another embodiment of the reel according to the invention, which for this purpose is characterized in that an incision is provided in the hinge rib.

According to the invention, a further preferred embodiment of the collapsible reel is characterized by reference openings which are provided in the flanges. When during the operation of joining the two reel halves and during the operation of extending the reel the reference openings in the two flanges are caused to coincide in the correct manner, the correct assembly position of the two reel halves as well as the maximum relative rotational movement and hence the correct position of the reel halves in the extended condition can be controlled in a simple manner.

A simple visual control of the degree of filling of the reel is possible in a further embodiment of the reel, by providing in the flanges control openings which are distributed along the circumferential direction and which overlap each other in the radial direction.

For winding the product to be packed onto the reels, the reels should generally be driven. For this purpose, a preferred embodiment of the reel according to the invention is characterized in that follower slots, which are regularly distributed along the circumference of the central opening, are provided in the flanges in such a manner that in the assembled condition of the reel the follower slots coincide pairwise. The relative angular position of the follower slots in the two flanges in the collapsed state of the reel depends upon the width of the bridge part and hence upon the necessary angular rotation of the two reel halves.

The reel halves may be made of different materials. Frequently used materials are cardboard, corrugated cardboard, synthetic material and the like. Due to the steps according to the invention, there is a possibility of using for the composition of the reel thin-walled materials with a minimum risk of damage during the manipulation of the reel.

In the first instance, the reels will be composed by the manufacturer or the supplier of two identical halves. Of course there is also the possibility for the reels to be composed by the user himself.

The invention will be described more fully with reference to the drawing. In the drawing.

Figure 1:
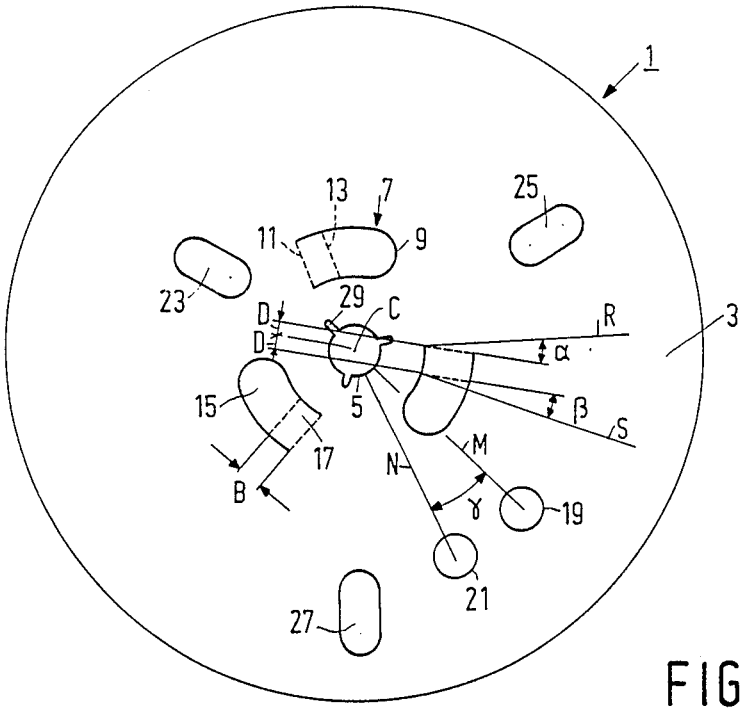
FIG. 1 shows a pretreated blank for a reel half.

FIG. 1 shows a flat blank for a reel half 1 consisting of a flat annular flange 3 having a central opening 5 and a number of expansion members 7 arranged near the central opening and distributed regularly in the circumferential direction. These expansion members take the form of an annular segment which is bounded by a loop-shaped incision 9 composed of lines of a circle and by an impressed folding rib 11 which is at right angles to the incision and by means of which the expansion member is hinged to the flange 3. The end of the expansion member 7 remote from the folding rib 11 is free.

Due to an impressed hinge rib 13, the expansion members are subdivided into a securing vane 15 and a bridge part 17 having a width B. The folding rib 11 and the hinge rib 13 are parallel to each other and enclose an acute angle $\alpha$ and $\beta$ with a radius R and S, respectively, which intersects the relevant rib, the ribs being situated with their prolonged parts at a certain distance D on either side of the center C of the central opening 5. The ribs 11 and 13 are slightly inclined backwards with respect to the free end of the expansion members 7.

The flange 3 is provided with two reference openings 19, 21 at the same distance from the center C of the opening 5. The radii M and N through the center of the reference openings 19 and 21 enclose an angle $\gamma$. Further, the flange is provided with three control openings 23, 25 and 27 at different distances from the center C. Along the periphery of the central opening 5, follower slots 29 are provided, which are uniformly distributed in the circumferential direction.

Figure 2:
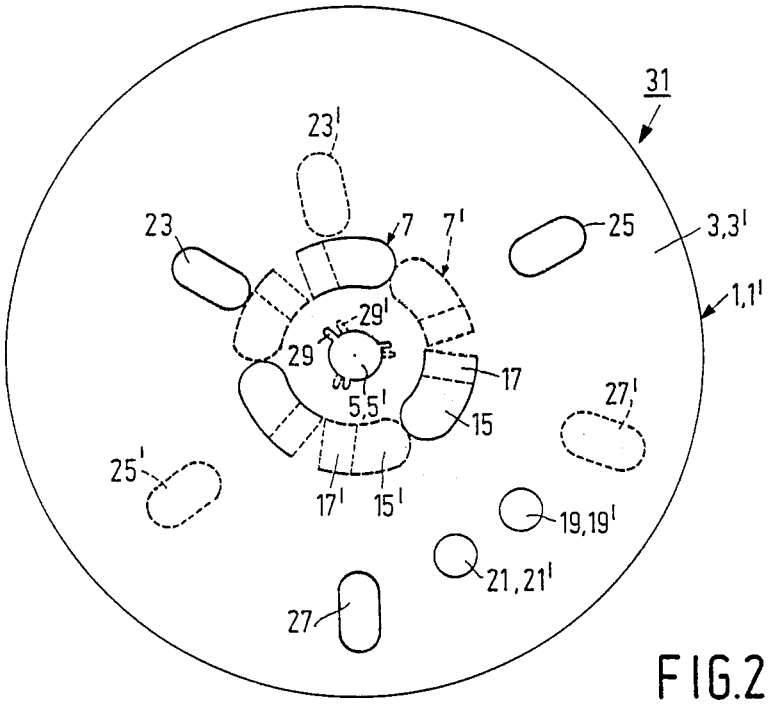
FIG. 2 shows a reel composed of two identical halves in the flat transport state.

FIG. 2 shows a reel 31, which is composed of two identical reel halves located one above the other in face to face relationship, the upper reel half being designated by reference numeral 1 and the lower reel half being designated by reference numeral 1' for the sake of clarity. The two halves can be joined by riveting the securing vanes 15 and 15' of one half to the flanges 3' and 3 of the other half. However, the vanes 15, 15' are preferably glued to the flanges 3', 3. FIG. 2 illustrates that in the shown collapsed flat condition of the reel 31 the expansion members 7 and 7', the control openings 23 and 23', 25 and 25', 27 and 27' and the follower slots 29 and 29' are relatively offset in the circumferential direction and do not overlap each other. The coinciding reference openings 19, 19' and 21, 21' indicate that the reel 31 is still in the flat collapsed condition.

The folding ribs 11, 11' and the hinge ribs 13,13' are arranged so that by a simple relative rotation of the two flanges in the direction of the free end of the expansion members 7, 7' the bridge parts 17, 17' will pivot about these ribs, the two flanges will be disengaged from each other and the reel is extended.

Figure 3:
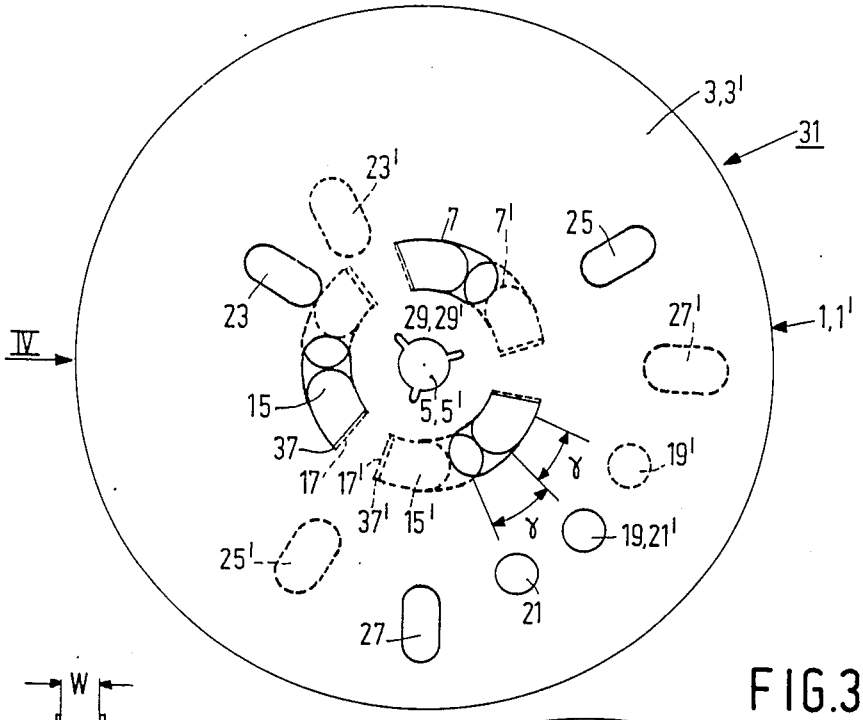
FIG. 3 shows the reel in the extended operating condition after a relative rotation of the two reel halves.
Figure 4:
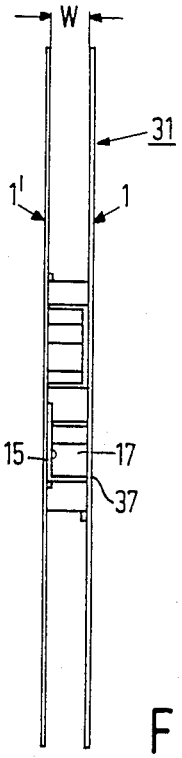
FIG. 4 shows the extended reel, viewed in the direction of the arrow IV in FIG. 3.

FIGS. 3 and 4 show the reel 31 in the extended condition ready for use. Due to the fact that, as already described, the folding ribs 11,11' and the hinge ribs 13, 13' are inclined backwards, a wringing moment or torsion is exerted on the bridge parts 17, 17' during the rotation of the flanges 3, 3' in such a manner that the bride parts pivot in the correct desired direction, that is to say inwards, viewed in the axial direction, and that the flanges 3, 3' are moved apart. FIG. 3 illustrates that in the extended condition of the reel 31 the follower slots 29, 29' coincide pairwise and that the reference opening 19 coincides with reference opening 21', which provides a visual indication that the two flanges 3, 3' are relatively displaced through the maximum permissible angle, that is to say through the angle $\gamma$. The angle $\gamma$ is determined by the width B of the bridge part 17. The width B again determines the free distance W between the flanges 3, 3'.

Figure 5:
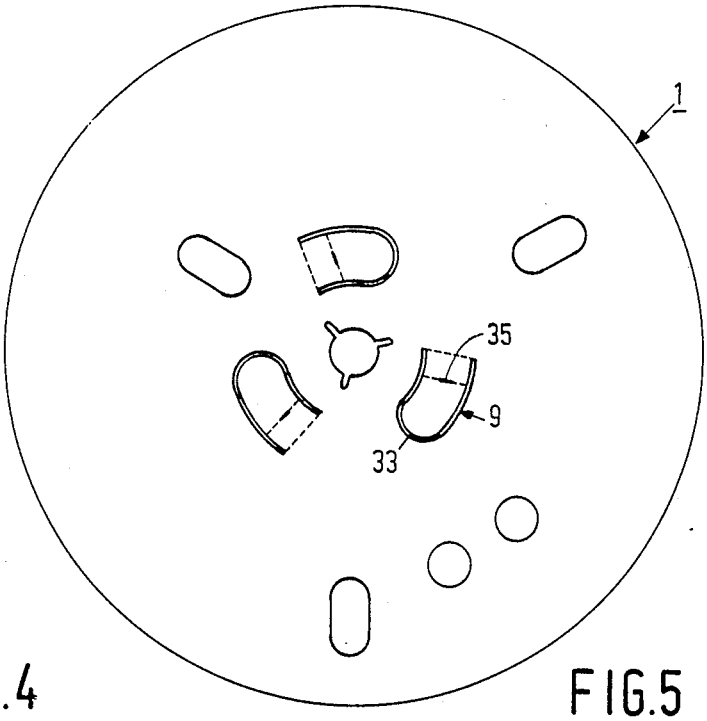
FIG. 5 shows another embodiment of the reel.
Figure 6:
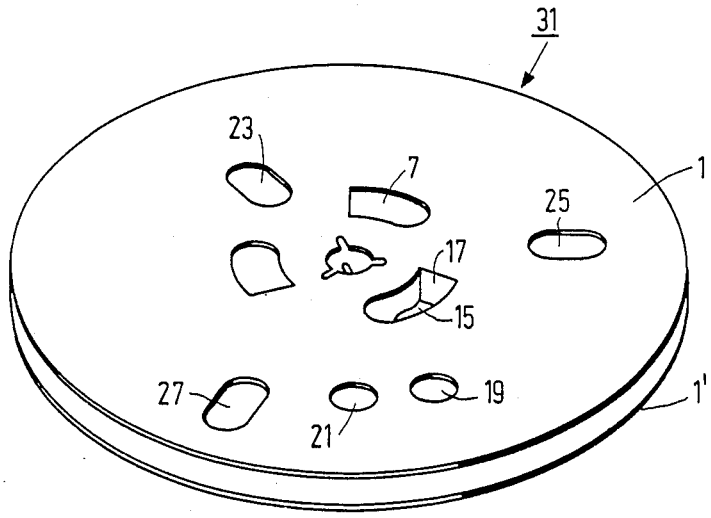
FIG. 6 is a perspective view of a reel ready for use.

In the embodiment of the reel half 1, shown in FIG. 5, the loop-shaped incision 9 is widened to form a gap 33 in such a manner that the expansion member in the non-deformed state is disengaged with certainty along the incision, as a result of which the extension of the reel is facilitated. The extension of the reel is further facilitated in that an incision 35 is provided in the hinge rib 13.

Due to the concentric annular profile of the expansion members 7, 7' and due to the fact that the bridge parts 17, 17' are relatively offset in the circumferential direction, the expansion members and more particularly the bridge parts are located on a circle in the extended condition of the reel with their free edge 37 directed radially outwards and constitute a reel core having approximately a cylindrical shape.

The reel according to the invention is inexpensive and is intended in the first instance for one-way use; however, if desired, the emptied reel may be collapsed again and may be kept ready for further use.

What is claimed is:

1. A collapsible reel which is composed of two identical halves each half comprising a flat circular flange having a central opening and a number of expansion members arranged near the central opening, said expansion members being regularly distributed in the circumferential direction and being bounded by incisions, each expansion member having a folding rib and a hinge rib across it, each expansion member including a securing vane and a bridge part, each securing vane being joined to its associated bridge part by its associated folding rib, each said bridge part being joined to the flange by its associated hinge rib, each said hinge rib extending parallel to its associated folding rib, said two reel halves being joined by means of said securing vanes to form said reel, said bridge parts constituting the reel core, said incisions extending substantially in or tangentially to the circumferential direction of the central opening and said folding ribs and said hinge ribs being arranged so that the reel can be extended by a relative rotational movement of the two reel halves.

2. A collapsible reel as claimed in claim 1 wherein the expansion members take the form of an annular segment and are bounded by a loop-shaped incision composed of lines of a circle.

3. A collapsible reel as claimed in claim 2, wherein the folding rib and the hinge rib enclose an acute angle with a radius intersecting the relevant rib.

4. A collapsible reel as claimed in any one of claims 1, 2 or 3, wherein the incisions are widened in such a manner that the expansion members are not in contact with the flange along the incision.

5. A collapsible reel as claimed in any one of claims 1, 2 or 3, wherein an incision is provided in the hinge rib.

6. A collapsible reel as claimed in any one of claims 1, 2 or 3, wherein reference openings are provided in the flanges.

7. A collapsible reel as claimed in any one of claims 1, 2 or 3, wherein the flanges are provided with control openings which are distributed in the circumferential direction and which overlap each other in the radial direction.

8. A collapsible reel as claimed in any one of claims 1, 2 or 3, wherein follower slots regularly distributed along the circumference of the central opening are provided in the flanges in such a manner that in the assembled condition of the reel the follower slots coincide pairwise.

9. A collapsible reel as claimed in any one of claims 1, 2 or 3, wherein the reel halves are made of cardboard.

10. A collapsible reel as claimed in any one of claims 1, 2 or 3, wherein the reel halves are made of synthetic material.

* * * * *